US006253482B1

(12) United States Patent
Peterson

(10) Patent No.: US 6,253,482 B1
(45) Date of Patent: Jul. 3, 2001

(54) PORTABLE SHOOTER'S REST

(76) Inventor: Thomas K. M. Peterson, 1815 N. Spring St., New Ulm, MN (US) 56073

( * ) Notice: Subject to any disclaimer, the term of this patent is extended or adjusted under 35 U.S.C. 154(b) by 0 days.

(21) Appl. No.: 09/397,713

(22) Filed: Sep. 16, 1999

(51) Int. Cl.[7] ..... F41A 27/00
(52) U.S. Cl. ..... 42/94
(58) Field of Search ..... D22/7; 42/94

(56) References Cited

U.S. PATENT DOCUMENTS

D. 261,794 * 11/1981 Bechtel .
3,012,350 * 12/1961 Wold .
3,225,656 * 12/1965 Flaherty et al. .
3,313,505 * 4/1967 Petrie .
4,207,699 * 6/1980 Hensley .
5,067,268 * 11/1991 Ransom .
5,421,115 * 6/1995 McKay .
5,808,227 * 9/1998 Amos .
5,930,931 * 8/1999 Watson .
5,979,099 * 11/1999 Kervin .
6,042,080 * 3/2000 Shepherd et al. .

* cited by examiner

*Primary Examiner*—Michael J. Carone
*Assistant Examiner*—Troy Chambers
(74) *Attorney, Agent, or Firm*—Roger W. Jensen

(57) ABSTRACT

A cover assembly for a shooter's rest for use with a bucket having a top opening The cover has a preselected opening in which is positioned a tubulaly-shaped support member having an internal bore. An elongated threaded rod is sized to slidably fit within the bore. A manually-rotatable wheel with a central-threaded bore is positioned on the threaded rod. A support means is attached to the upper end of the threaded rod.

8 Claims, 3 Drawing Sheets

PORTABLE SHOOTER'S REST

BACKGROUND OF THE INVENTION

The prior art for this field includes a shooter's rest for supporting the front end of a rifle or pistol while the shooter supports the other end of the firearm, examples being the cross-sticks type shooting rests shown in U.S. Pat. Nos. 5,406,732 and 5,930,932. Another arrangement sometimes used for accurate shooting is to have a firearm supported on a sandbag placed on top of a table or other support.

There continues to be a need for a portable, i.e., lightweight, shooter's rest that facilitates high accuracy shooting in the field; a level of accuracy higher than that which can be attained by using the prior art crossed-sticks shown in the aforementioned U.S. Pat. Nos. 5,406,732 and 5,930,932.

SUMMARY OF THE INVENTION

The present invention, in its simplest form, is a specially-equipped lid or cover for a three, five, or seven (or other) gallon bucket. An adjustable twelve-inch ACME threaded rod is fitted at its top end with a gun pivoting yoke. The threaded rod is vertically adjustable through rotation of a hand-turned mariner's wheel. The fluted rubber shooting yoke will support either the buttstock or the fore-end of the rifle or other firearm. The shooting rest may be used by the shooter by itself, or in combination with one of the prior art means for supporting the fore-end of the rifle, such as the apparatus shown in the above-mentioned U.S. Pat. No. 5,406,732, or a cross-stick product, Steady-Stix™, sold by Stoney Point Products, Inc., New Ulm, Minn. and shown in Applicant's U.S. Pat. No. 5,930,932.

DETAILED DESCRIPTION OF THE INVENTION

Figure 2:
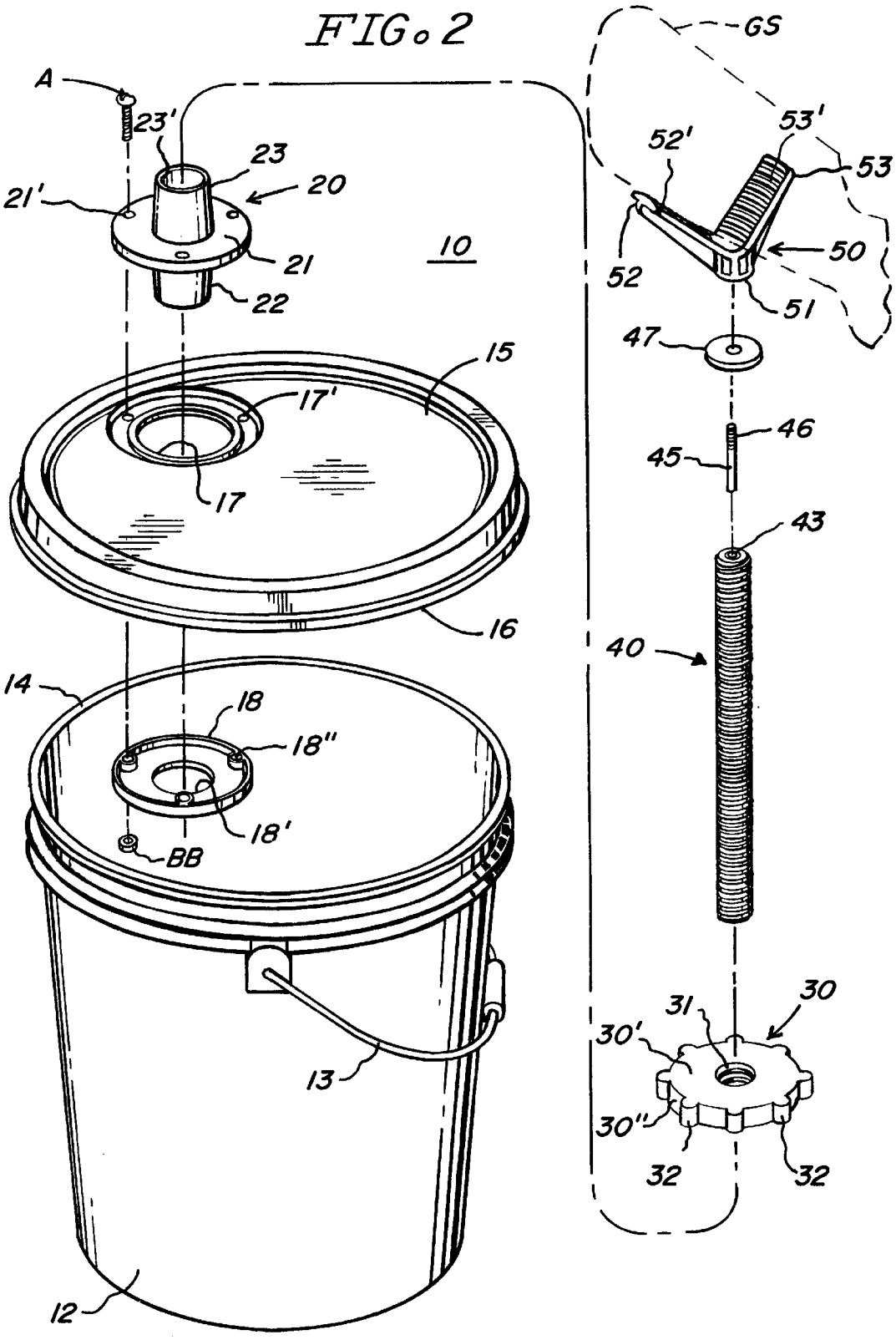
FIG. 2 shows an isometric, partially-exploded view of the invention.

Referring to FIG. 2, the reference numeral 10 designates a shooter's rest comprising a bucket 12 having a top opening and a rim 14, as well as a standard handle assembly 13. The invention further comprises a complimentary cover assembly which includes a standard cover 15 having a circumferential rim or edge 16. In the preferred embodiment, the bucket 12 and matching cover 15 are made of plastic and are of the type in widespread use for transporting fluid products such as paint, drywall-joint cement, etc. However, the bucket and/or cover may be made out of other materials such as aluminum or steel. The top surface of cover 15 is shown to be substantially flat with the exception of a circular depression in one quadrant thereof, in which is cut a preselected circular opening 17. As shown, the opening 17 is offset from the center of cover 15; in some applications of the invention it may be preferable to have the opening in the center. A plurality of bores or holes 17' are provided around the periphery of opening 17. A tubularly-shaped support member 20 is provided, having a longitudinal axis and lower and upper ends 22 and 23, and (as is also shown in FIG. 4) an internal bore 23' having an internal key portion CC and a radially-extending circularly-shaped skirt 21 positioned intermediate the ends 22 and 23, and sized somewhat larger than opening 17 of cover 15.

Fastening means are provided for attaching the skirt of the support member 20 to the cover so that the support member is positioned in opening 17 with the longitudinal axis of the bore 23' substantially perpendicular to the top of the cover. The fastening means includes a bottom washer-like member or plate 18 and a plurality of screws A, which pass through bores or openings 21', 17' and 18' of bottom plate 18, and are threaded into suitable nuts BB as shown in FIG. 2.

Figure 5:
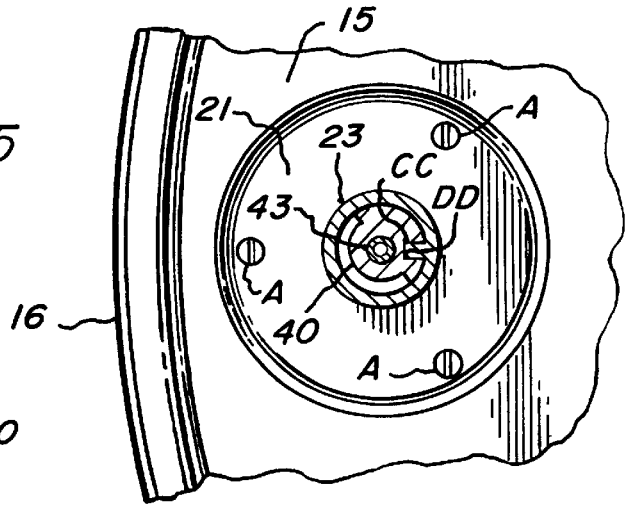
FIG. 5 is a view of the apparatus shown in FIG. 4 as viewed along section lines 5—5 thereof.

The unique cover assembly further includes an elongated threaded (preferable ACME) rod 40 sized to slidably fit within and be positioned within the internal bore 23' of the support member 20. The threaded rod 40 has a longitudinal external keyway DD shown in FIGS. 4 and 5, which is sized to closely engage key CC. The threaded rod 40 further has a central longitudinally-extending bore 41 in which is positioned a suitable metal tube 43 having a bore 43'. The tube 43 provides strength to the assembly. In the preferred embodiment, the threaded rod 40 is a suitable plastic molded about the tube 43, which preferably is aluminum but could be steel or other strong material. The tube 43 extends the full length of member 40 as is shown in FIG. 4. In the preferred embodiment, the aluminum tube 43 has an outer diameter of 0.375 inches and an inner diameter of 0.25 inches. Positioned in the top end of tube 43 is one end of a small diameter rod 45, the threaded top end 46 of which passes through a central opening in a washer 47 into a yoke or firearm support means 50 having a central hub 51 and a pair of angled-apart supporting arms 52 and 53 with ribbed surfaces 52' and 53' for cradling or supporting, for example, the buttstock GS of a firearm. In the preferred embodiment the supporting arms 52 and 53 with surfaces 52' and 53' are made out of a non-marring material such as hard rubber, to hold and support the buttstock GS without any scratching or marring thereof.

Figure 4:
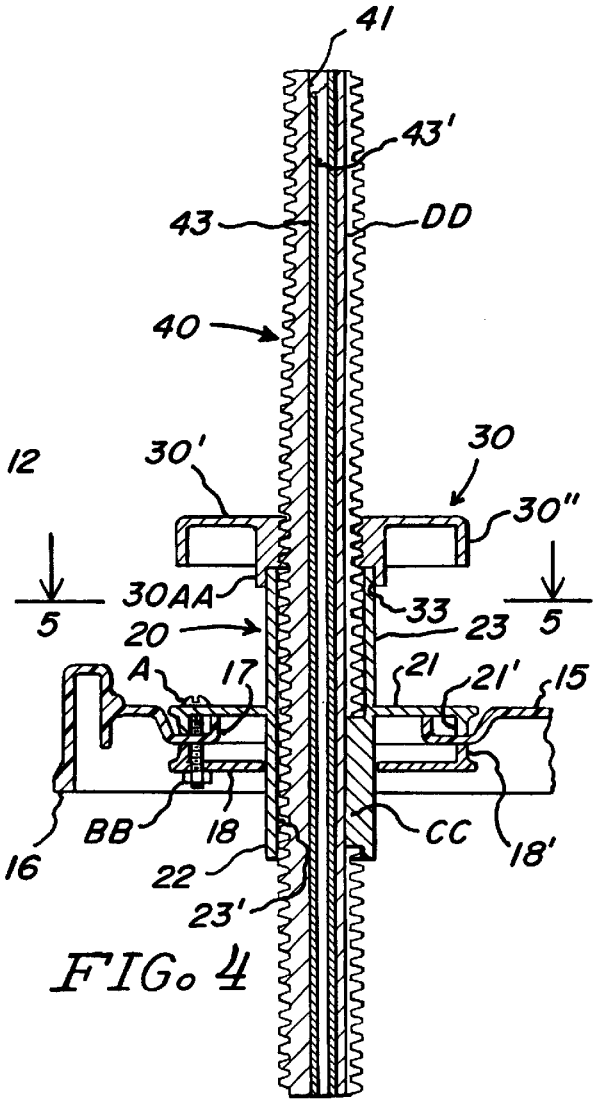
FIG. 4 is a cross-sectional view of the apparatus shown in FIG. 3, as viewed along section lines 4—4 thereof.

A manually-rotatable wheel 30 which may be termed a "mariner's wheel" is shown in FIG. 2 and comprises a central-threaded bore 31 sized to engage and be positioned on the threaded rod 40, and further comprises, as shown best in FIG. 4, a central axially-downwardly-extending hub 30AA which is concentric with said central-threaded bore 31, and is sized to engage and to receive the upper end 23 of the tubular support member 20.

OPERATION

Figure 1:
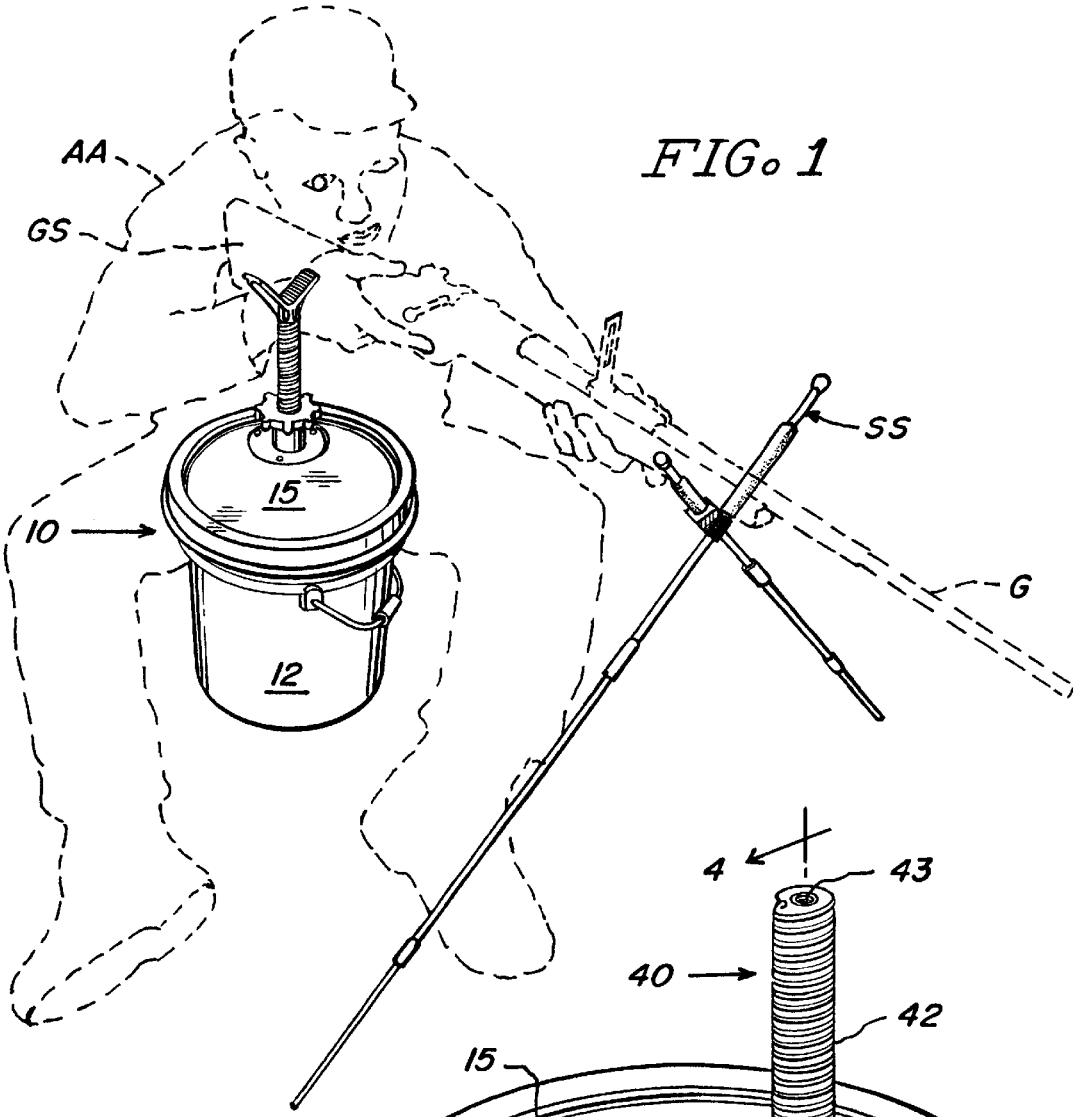
FIG. 1 shows an isometric view of the present invention being utilized by a shooter AA shooting a firearm G, with the buttstock or gunstock GS of the firearm being supported by the yoke member of the invention and the fore-end of the firearm being supported by a pair of prior art crossed-sticks SS.
Figure 3:
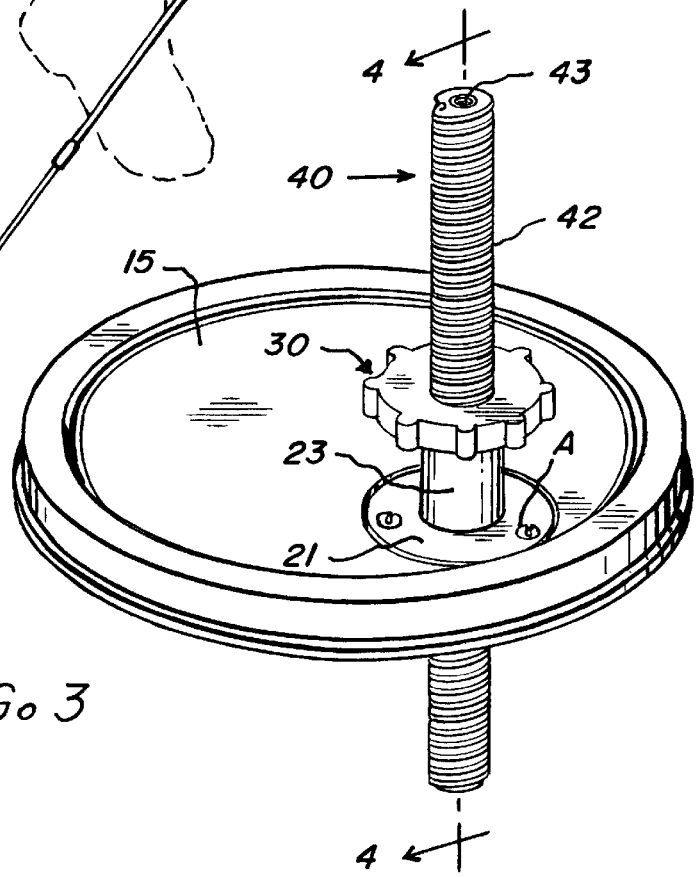
FIG. 3 shows, in isometric from, the cover assembly.
Figure 6:
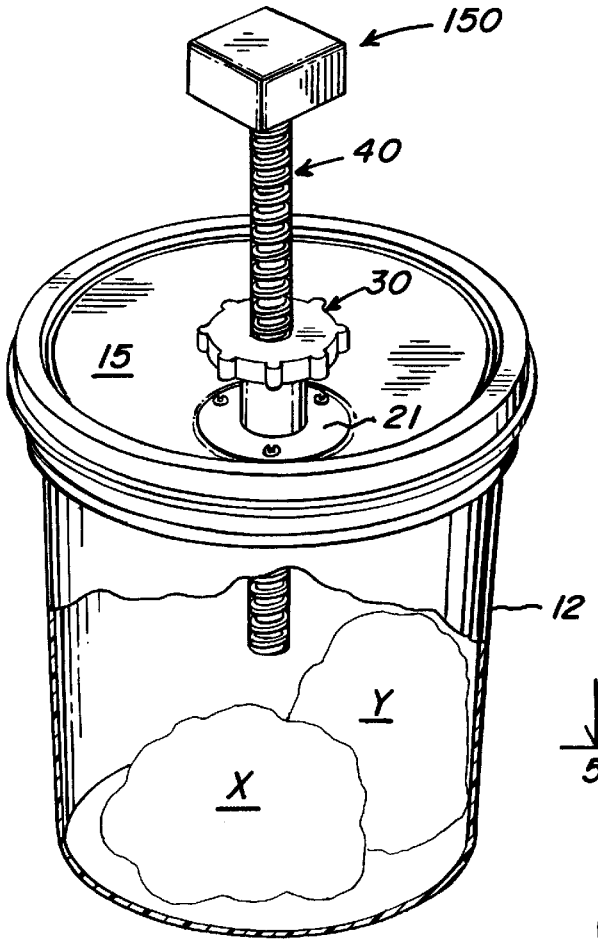
FIG. 6 is a view of the invention with a portion of the bucket cut away to show ballast X and Y, and also to show an alternate support means 150, mounted at the top end of the elongated threaded rod 40.

Operation and use of the invention is very simple. The shooter may choose to put materials X and Y within the bucket, such as is shown in FIG. 6, so as to provide ballast (rocks, sand or even water can be used). Alternately, the bucket could be used for carrying ammunition, food supplies, or other necessities. The shooter, in the scenario depicted in FIG. 1, would rest the buttstock GS of the firearm on the yoke support means 50 and (optionally) could use some means such as cross-sticks SS for supporting the fore-end of the firearm G such as is shown in FIG. 1. As shown in FIG. 1, the shooter AA is in a sitting position with the bucket/cover assembly 10 positioned between his legs. The mariner's wheel 30 may be rotated to either raise or lower the elevation of the support 50. When the mariner's wheel 30 is rotated in one sense, e.g., clockwise with respect to the threaded rod 40, this will have the effect of raising the top end of the rod and thus the support means 50, it being understood that the hub 30AA on the mariner's wheel will engage with the top of the upper end 23 of the support member 20, to provide the aforesaid lifting or increasing of elevation. Conversely, if the mariner's wheel is rotated counterclockwise or opposite rotation, this will have the effect of lowering the elevation.

The shooter's rest shown in FIG. 6 has an alternate flat plate type support 150 on the top end of rod 40; support 150 may be used to support a small sandbag (not shown) or other item(s). Also, the invention may be used as a seat for shooter AA; this arrangement would require a reconfigured support 150 and opening 17 might preferably be located in the center of cover 15.

While the present invention is relatively simple, the results obtained from field tests are outstanding. For example, it is not difficult for a shooter to have quarter inch groups of five in a target at a distance of 100 yards.

It should be understood that my invention in its most complete form comprises a complete bucket with complementary cover assembly as described above. However, in another context, it should be recognized that buckets of the type disclosed are widely available. Hence, the invention can logically considered in subcombination form, i.e., a cover assembly to be used with a bucket for a shooter's rest.

While the preferred embodiment of the invention has been illustrated, it will be understood that variations may be made by those skilled in the art without departing from the inventive concept. Accordingly, the invention is to be limited only by the scope of the following claims.

What is claimed is:

1. A shooter's rest comprising a bucket having a top opening and a complementary cover assembly, said cover assembly comprising:

a) a cover sized to fit on top of said bucket, said cover having a top surface with a preselected opening therethrough;

b) a tubularly-shaped support member having a longitudinal axis with upper and lower ends, an internal bore having an internal key portion, and a radially-extending circularly-shaped skirt positioned intermediate said ends and sized larger than said opening of said cover;

c) fastening means for attaching said skirt to said cover so that said support member is positioned in said opening of said cover and said longitudinal axis of said bore of said support member is substantially perpendicular to the top of said cover;

d) an elongated threaded rod sized to slidably fit within and positioned within said internal bore of said support member and further having a keyway sized to slidably match said internal key portion of said support member;

e) a manually-rotatable wheel having a central-threaded bore sized to engage and positioned on said threaded rod and a central axially-downwardly-extending hub concentric with said central-threaded bore and sized to engage and to receive said upper end of said support means; and f) a support means attached to the upper end of said threaded rod.

2. Apparatus of claim 1 wherein said support means attached to the upper end of said threaded rod is preconfigured to receive and support one part of a firearm.

3. Apparatus of claim 2 wherein said one part of a firearm is the stock of a firearm.

4. Apparatus of claim 1 wherein said support means attached to the upper end of said threaded rod is a member having a top supporting surface laterally extending from said rod.

5. A cover assembly for a shooter's rest comprising a bucket having a top opening and a complementary cover assembly, said cover assembly comprising:

a) a cover sized to fit on top of said bucket, said cover having a top surface with a preselected opening therethrough;

b) a tubularly-shaped support member having a longitudinal axis with upper and lower ends, an internal bore having an internal key portion, and a radially-extending circularly-shaped skirt positioned intermediate said ends and sized larger than said opening of said cover;

c) fastening means for attaching said skirt to said cover so that said support member is positioned in said opening of said cover and said longitudinal axis of said bore of said support member is substantially perpendicular to the top of said cover;

d) an elongated threaded rod sized to slidably fit within and positioned within said internal bore of said support member and further having a keyway sized to slidably match said internal key portion of said support member;

e) a manually-rotatable wheel having a central-threaded bore sized to engage and positioned on said threaded rod and a central axially-downwardly-extending hub concentric with said central-threaded bore and sized to engage and to receive said upper end of said support means; and f) a support means attached to the upper end of said threaded rod.

6. Apparatus of claim 5 wherein said support means attached to the upper end of said threaded rod is preconfigured to receive and support one part of a firearm.

7. Apparatus of claim 6 wherein said one part of a firearm is the stock of a firearm.

8. Apparatus of claim 5 wherein said support means attached to the upper end of said threaded rod is a member having a top supporting surface laterally extending from said rod.

* * * * *